US007401431B2

(12) United States Patent
Pierce et al.

(10) Patent No.: US 7,401,431 B2
(45) Date of Patent: Jul. 22, 2008

(54) TRIGGER ACTUATED STABILIZATION DEVICE

(75) Inventors: Rodney W. Pierce, Everett, WA (US); Michael R. Fox, Eagle Creek, OR (US)

(73) Assignee: Outback Concepts, LLC, Hillsboro, OR (US)

( * ) Notice: Subject to any disclaimer, the term of this patent is extended or adjusted under 35 U.S.C. 154(b) by 0 days.

(21) Appl. No.: 11/021,563

(22) Filed: Dec. 22, 2004

(65) Prior Publication Data

US 2008/0134560 A1 Jun. 12, 2008

(51) Int. Cl.
*F41A 23/10* (2006.01)
*F41C 27/22* (2006.01)

(52) U.S. Cl. ..... 42/94; 89/37.04

(58) Field of Classification Search ..... 42/94; 89/37.04, 40.06
See application file for complete search history.

(56) References Cited

U.S. PATENT DOCUMENTS 271,251 A * 1/1883 Leerbech et al. ..... 42/94
2,489,283 A * 11/1949 Garand ..... 42/94
2,870,683 A * 1/1959 Wilson ..... 89/40.06
4,397,112 A * 8/1983 York ..... 42/94
4,607,561 A * 8/1986 Frimer ..... 89/37.04
5,074,188 A 12/1991 Harris et al.
5,345,706 A * 9/1994 Brown ..... 42/94
5,390,885 A * 2/1995 Shen ..... 248/168
5,410,835 A * 5/1995 Vetter ..... 42/94
5,815,974 A 10/1998 Keng
6,487,807 B1 * 12/2002 Kopman et al. ..... 42/94
6,663,071 B2 12/2003 Peterson
6,763,627 B1 7/2004 Kaempe
6,829,857 B1 * 12/2004 Houtsma ..... 42/94
2002/0014974 A1 * 2/2002 Ghahramani ..... 340/815.4

* cited by examiner

*Primary Examiner*—Bret Hayes
(74) *Attorney, Agent, or Firm*—Kolisch Hartwell, P.C.

(57) ABSTRACT

An apparatus, system, and method for a trigger actuated stabilization device are disclosed herein.

16 Claims, 4 Drawing Sheets

TRIGGER ACTUATED STABILIZATION DEVICE

FIELD OF THE INVENTION

Embodiments of the invention relate generally to the field of firearms, and more particularly to a trigger actuated stabilization device for providing stability to such a firearm.

BACKGROUND OF THE INVENTION

Discharge of a firearm is done at a distance from the operator along the operator's line of sight. The distance may be due to the extension of operator's arms (e.g., when the firearm is a pistol) or to the elongated nature of the firearm (e.g., when the firearm is a rifle). Accuracy in discharging the firearm requires that the distal end of the firearm be held steady for a period of time to aim and subsequently discharge the firearm. The steadiness required during the aiming and discharge of the firearm usually requires auxiliary support for sufficient stabilization.

Bipods have been attached to the firearm in an attempt to provide portable stabilization for the discharging of the firearm. Some of these prior art bipods have legs that transition between a stored position, with the legs next to the barrel of the firearm, and a deployed position, with the legs rotated away from the barrel so that the firearm can rest on a surface via the legs. However, these prior art bipods provide awkward deployment mechanisms that typically require both hands. Additionally, prior art bipods are bulky, even in the stored position, and increase the overall dimensions and weight of the combined firearm/bipod. This additional bulk compromises the portability of the combined firearm/bipod.

BRIEF DESCRIPTION OF THE DRAWINGS

Embodiments of the invention are illustrated by way of example and not by way of limitation in the figures of the accompanying drawings, in which like references indicate similar elements and in which.

DETAILED DESCRIPTION

Illustrative embodiments of the present invention include a trigger-actuated stabilization device for stabilizing a firearm.

Various aspects of the illustrative embodiments will be described using terms commonly employed by those skilled in the art to convey the substance of their work to others skilled in the art. However, it will be apparent to those skilled in the art that alternate embodiments may be practiced with only some of the described aspects. For purposes of explanation, specific materials and configurations are set forth in order to provide a thorough understanding of the illustrative embodiments. However, it will be apparent to one skilled in the art that alternate embodiments may be practiced without the specific details. In other instances, well-known features are omitted or simplified in order not to obscure the illustrative embodiments.

Further, various operations will be described as multiple discrete operations, in turn, in a manner that is most helpful in understanding the present invention; however, the order of description should not be construed as to imply that these operations are necessarily order dependent. In particular, these operations need not be performed in the order of presentation.

The phrase "in one embodiment" is used repeatedly. The phrase generally does not refer to the same embodiment; however, it may. The terms "comprising," "having," and "including" are synonymous, unless the context dictates otherwise.

Figure 1:
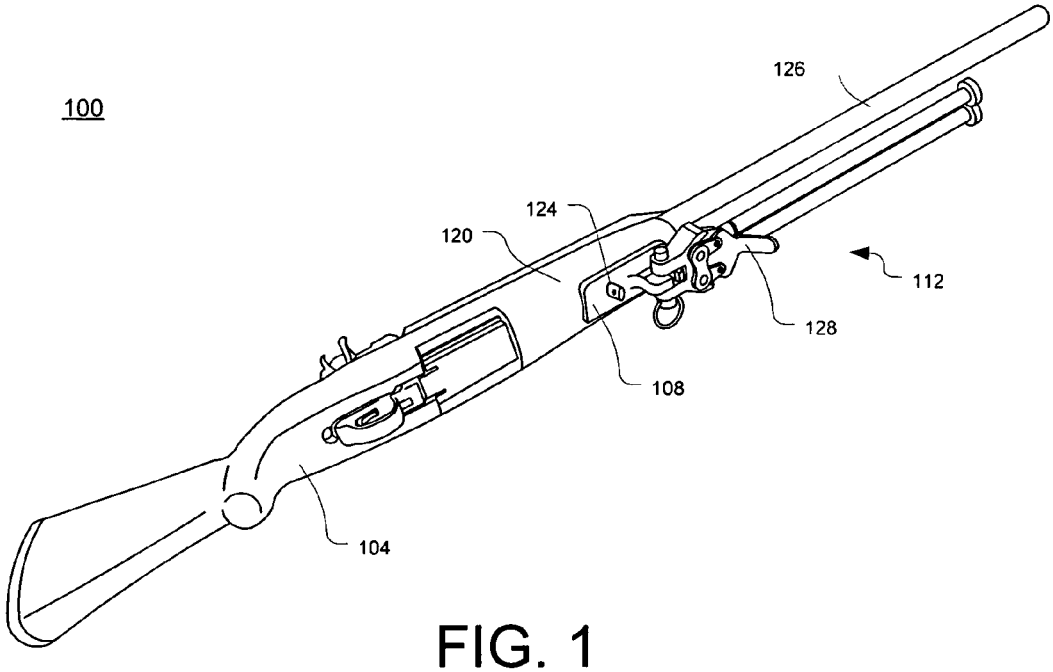
FIG. 1 illustrates a perspective view of a system including a stabilization device and mount coupled to a firearm with the stabilization device being in a stored position, in accordance with an embodiment of the present invention.

FIG. 1 depicts a perspective view of a system 100 to facilitate the stabilized discharge of a firearm 104 in accordance with an embodiment of the present invention. In particular, the system 100 may include a mount 108 that is designed to couple a stabilization device 112 to the firearm 104. The stabilization device 112 may have two legs 116 and may, in this instance, be referred to as a bipod. In other embodiments, the stabilization device 112 may have one leg, i.e., monopod, or more than two legs, e.g., tripod or polypod.

In one embodiment, the mount 108 may be coupled to a fore-end 120 of a stock of the firearm 104, as shown in FIG. 1. The mount 108 may have a surface that is contoured in a manner to complement the coupling surface of the firearm, e.g., the portion of the fore-end 120 that the mount 108 is coupled to. In another embodiment, the mount 108 may be coupled to the barrel of the firearm 104. In one embodiment the mount 108 may be coupled to the fore-end 120 by a bolt 124 to serve as an attachment point for a sling (not shown).

FIG. 1 illustrates the stabilization device 112 in a stored position. In the stored position, the stabilization device 112 may be disposed in a manner that positions the legs 116 substantially parallel to one another and to the mounting surface of the mount 108. With the stabilization device 116 so disposed, the legs 116 may be adjacent to a barrel 126 of the firearm 104 as shown in FIG. 1. This design may allow for the stabilization device 116 to be substantially within the outer profile dimensions of the firearm 104 while in the stored position. This may in turn facilitate the portability of the system 100 in accordance with an embodiment of the present invention.

Figure 2:
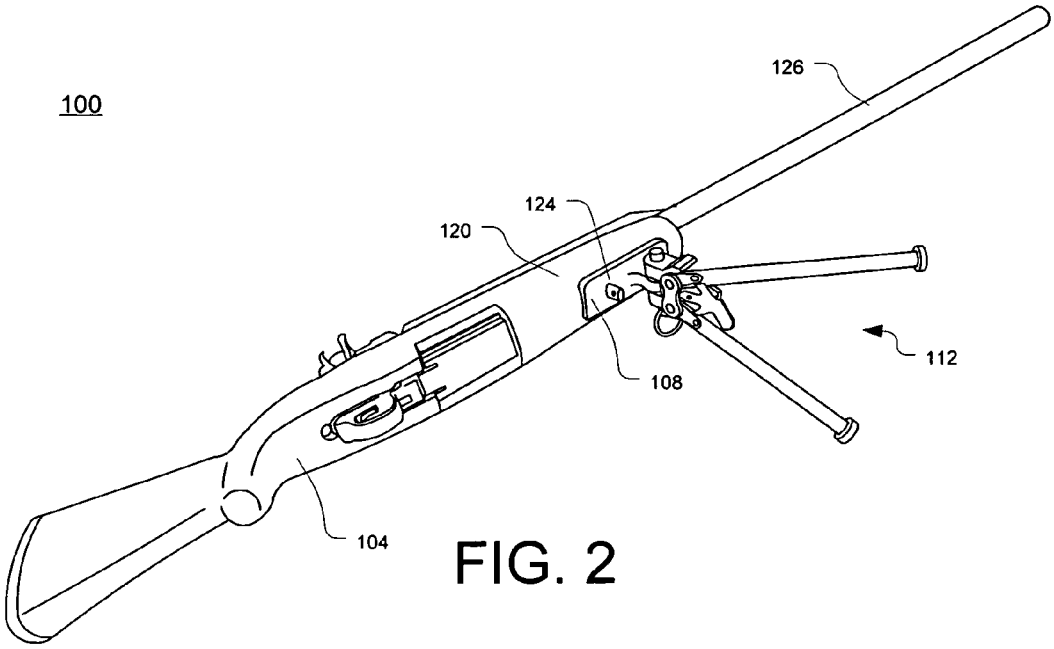
FIG. 2 illustrates a perspective view of the system with the stabilization device being in a deployed position, in accordance with an embodiment of the present invention.

The stabilization device 112 may have a trigger mechanism 128 that when actuated allows the stabilization device 112 to transition between the stored position, illustrated in FIG. 1, and the deployed position, illustrated in FIG. 2, in accordance with an embodiment of the present invention. The actuation of the trigger mechanism 128, which will be described later in further detail, may be easily accomplished with one hand, allowing the operator to hold the firearm 104 with the other. Additionally, the actuation of the trigger 128 may be accomplished in one motion, which could provide for rapid deployment of the stabilization device 112.

The deployed position of the stabilization device 112 illustrated in FIG. 2, may position the legs 116 in a manner to allow them to contact a supporting surface to transfer at least a portion of the weight of the firearm 104 to the supporting surface. The support provided by the stabilization device may be used to facilitate the aiming and subsequent discharge of the firearm 104. In various embodiments, the legs 116 may have adjustable lengths to accommodate the orientation of the operator, e.g., standing, kneeling, or laying, as well as the topography of the terrain that is used as a supporting surface. In one embodiment, the legs 116 may be adjustable through a telescoping manner.

In various embodiments, the firearm 104 may be any type of device adapted to propel a projectile with a high velocity. In one embodiment, the propulsion force may be provided by deflagration caused by an incendiary such as, e.g., gunpowder. However, the firearm 104 is not so limited in other embodiments. For example, in another embodiment, the propulsion force may be applied to the projectile through gas pressure. Therefore, in various embodiments the firearm 104 may be, but is not limited to, a rifle, a gun, a pistol, or an air gun. The firearm 104 may be designed for use in a number of applications including, but not limited to, police and military uses, hunting, or gaming (e.g., paintball).

Figure 3:
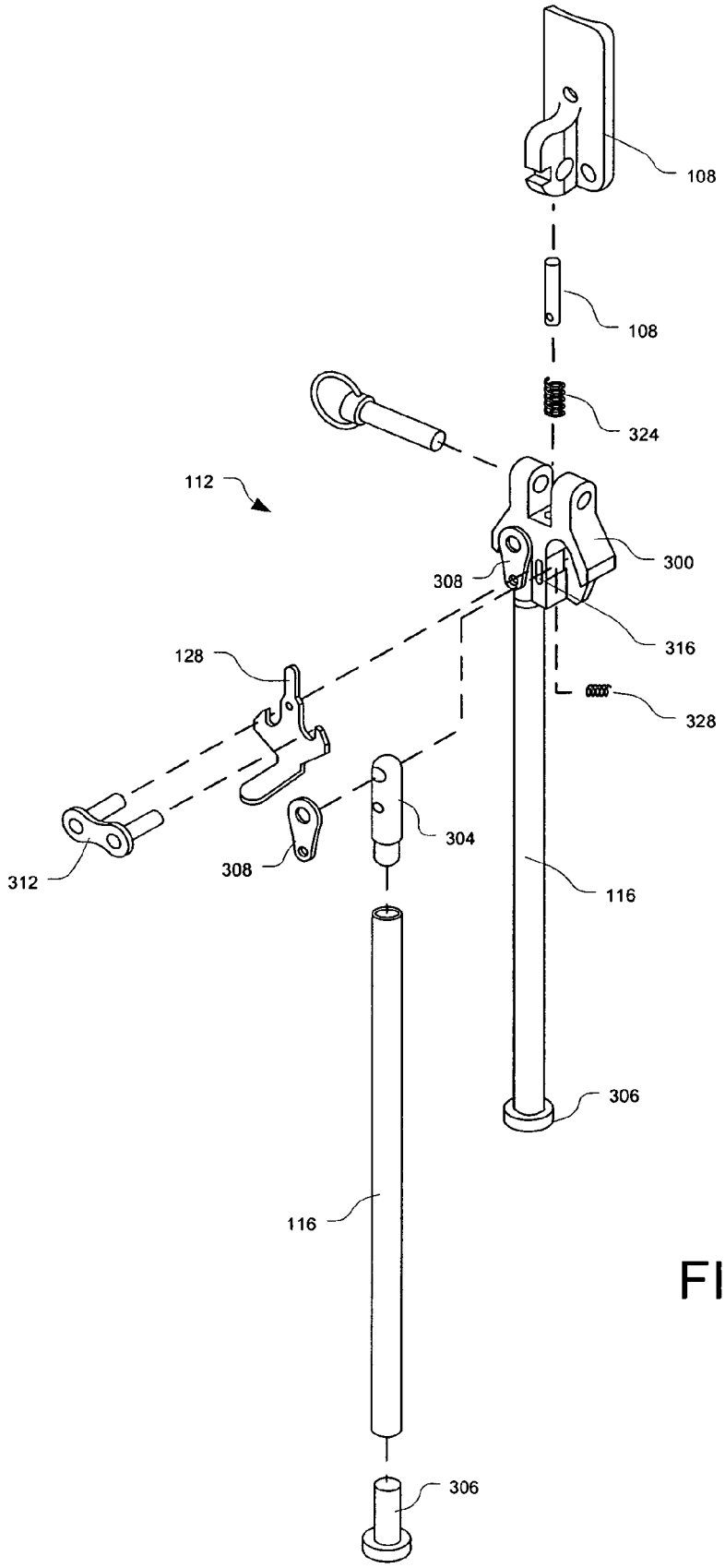
FIG. 3 illustrates a partially-exploded perspective view of the stabilization device, in accordance with an embodiment of the present invention.

FIG. 3 illustrates a partially exploded perspective view of the stabilization device 112 and the mount 108 in accordance with an embodiment of the present invention. The stabilization device 112 may include a head unit 300 coupled to the legs 116. More particularly, the legs 116 may be coupled to the head unit 300 through leg tops 304. In one embodiment, the leg tops 304 may be compression fit into the cavity of the legs 116. Other embodiments may employ other coupling mechanisms such as, but not limited to, screw tops. In still other embodiments, the design and functionality of the legs tops 304 may be incorporated into the legs 116 themselves, with the legs 116 being more directly coupled to the head unit 300. The distal end of the legs 116 may be fit with plugs 306 or caps (not shown). In one embodiment, the plugs 306 may be a rubber material that is designed to provide traction with the supporting surface.

In one embodiment, the leg tops 304 may be statically coupled with cams 308, i.e., coupled in a manner that substantially restricts relative movement between the cams 308 and the leg tops 304. The cams 308 and leg tops 304 may be pivotally coupled to the head unit 300 by a connecting link 312, which in one embodiment may be a #50 chain link. The trigger 128 may be coupled to the face of the head unit 300 between the cams 308. The trigger 128 may additionally be coupled to a center-pin 312 through a hole 316 in the head unit 300. The center-pin 312 may be disposed in an internal cavity 320 of the head unit 300 along with a seat spring 324. Additionally, a pair of springs 328 (only one shown) may be positioned to facilitate the opening of the legs 116 during deployment. Another embodiment may use one spring placed in a through hole of the partition of the head unit 300 that separates the leg tops 304.

Figure 4:
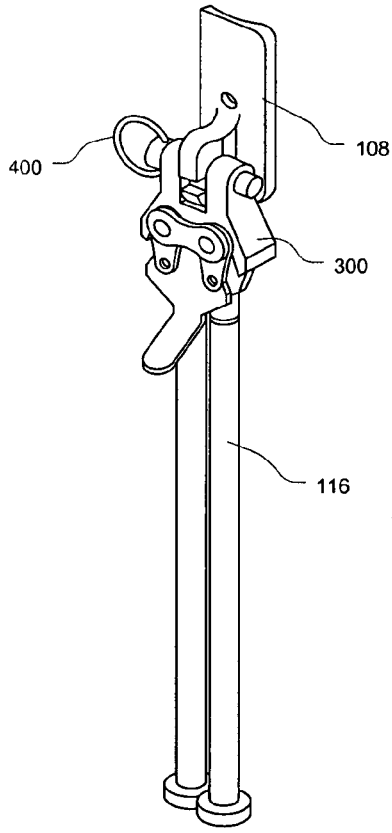
FIG. 4 illustrates an assembled perspective view of the stabilization device, in accordance with an embodiment of the present invention.

FIG. 4 illustrates a perspective view of an assembled stabilization device 112 coupled to the mount 108, in accordance with an embodiment of the present invention. The stabilization device 112 may be coupled to the mount 108 by a pull-pin 400. This may facilitate the rapid and convenient coupling/decoupling of the stabilization device 112 without affecting the mount 108 or the bolt 124. For example, in one embodiment, a sling coupled to the sling loop of the bolt 124 may be unaffected through the coupling/decoupling of the stabilization device 112.

Figure 5:
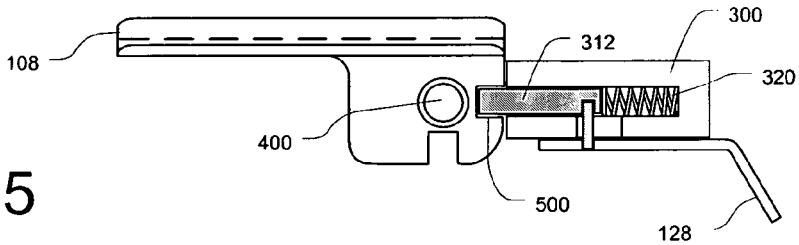
FIG. 5 illustrates a cross-sectional view of a head unit coupled to the mount in the stored position, in accordance with an embodiment of the present invention.

FIG. 5 illustrates a cross-sectional view of the head unit 300 coupled to the mount 108 in the stored position, in accordance with an embodiment of the present invention. The seat spring 320 may cooperate with the center-pin 312 such that the center-pin 312 engages the mount 108 in order to secure the head unit 300 in the stored position. More specifically, the mount 108 may have a recess 500 to receive at least a portion of the center-pin 312 while the head unit 300 is in the stored position. The center-pin 312 being partially disposed in both the recess 500 and the cavity of the head unit 300 may inhibit relative motion between the head unit 300 and the mount 108.

In one embodiment, the trigger 128 may be coupled to the center-pin 312. When the trigger 128 is actuated, the center-pin 312 may be pressed into the seat spring 320 and may disengage the mount 108. The disengagement of the center-pin 312 from the mount 108 may allow the head unit 300 to rotate around the pull-pin 400 into the deployed position as shown in embodiment illustrated in the cross-sectional view of FIG. 6. Once in the deployed position, the seat-spring 320 may cause the center-pin 312 to engage a deployed recess 600 of the mount 108, thereby securing the stabilization device 112 in the deployed position. The transition from the deployed position to the stored position may be accomplished in a similar manner. The actuation of the trigger 128 may not only allow for the head unit 300 to transition between the stored and deployed positions, but may also allow for the legs 116 to transition between the deployed and stored positions.

Figure 7:
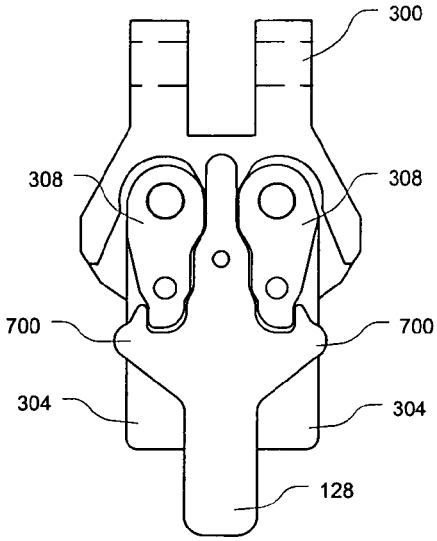
FIG. 7 illustrates a front view of various components of the stabilization device being in the stored position, in accordance with an embodiment of the present invention.
Figure 8:
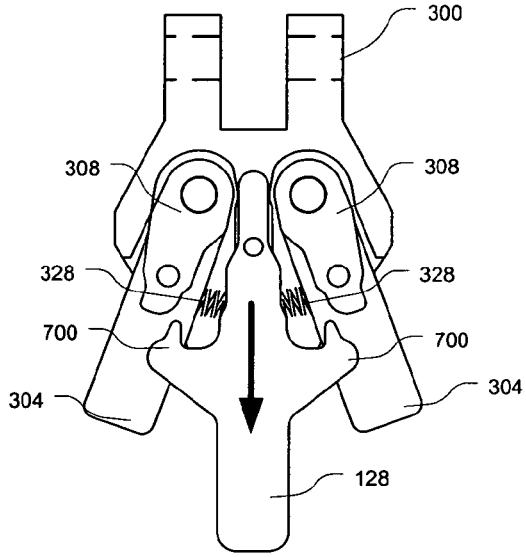
FIG. 8 illustrates a front view of the various components of the stabilization device in transition from the stored position to the deployed position, in accordance with an embodiment of the present invention.

FIG. 7 illustrates a front view of various components of the stabilization device in the stored position, in accordance with an embodiment of the present invention. In this embodiment, the cams 308 and the trigger 128 may be of complementary designs such that when the trigger 128 is in the biased position and the leg tops 304 are substantially parallel, the wings 700 of the trigger will catch the cams 308 and prevent the legs tops 304 from spreading out. When the trigger 128 is actuated, as illustrated in FIG. 8, the wings 700 may release the cams 308, and the statically coupled leg tops 304. The leg tops 304 may then rotate outward around the pivot axes provided by the connecting link 312. In one embodiment, springs 328 may provide the force necessary for the leg tops 304 to rotate outward into the deployed position. In another embodiment the trigger 128 and cams 308 may be designed such that the linear actuating motion of the trigger 128 is translated into an angular force to separate the leg tops 304.

Figure 9:
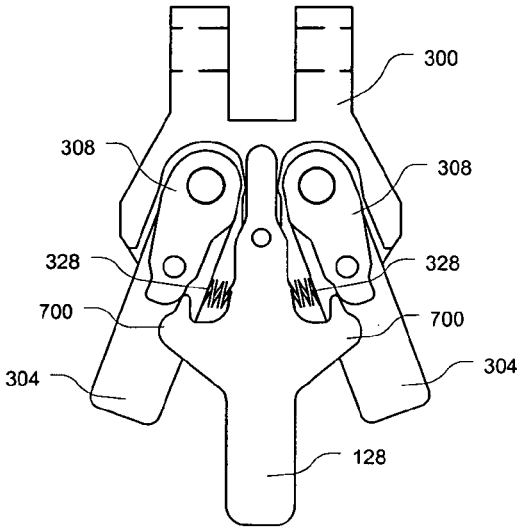
FIG. 9 illustrates a front view of the various components of the stabilization device in the deployed position, in accordance with an embodiment of the present invention.

Once the leg tops 304 rotate out a certain degree, the trigger 128 may be released so that is slides back into its biased state. In one embodiment, the outer portion of the wings 700 may then contact the inner portion of the cams 308 and act as a wedge to facilitate the full range of rotation of the leg tops 304. As shown in FIG. 9, the trigger 128 settled back into the biased state may help to secure the leg tops 304 in the deployed position. Furthermore, the inset design of the head unit 300 may determine the range of rotation of the leg tops 304. Referring also to FIG. 2, with the stabilization device 112 being in the deployed position, the reactive upward force from the support surface may cause the leg tops 304 to press against the outer dimensions of the inset of the head unit 300. This may also facilitate the securement of the stabilization device 112 in the deployed position.

The relationship between the components of the stabilization device 112 may facilitate the transitioning of the leg tops

Figure 6:
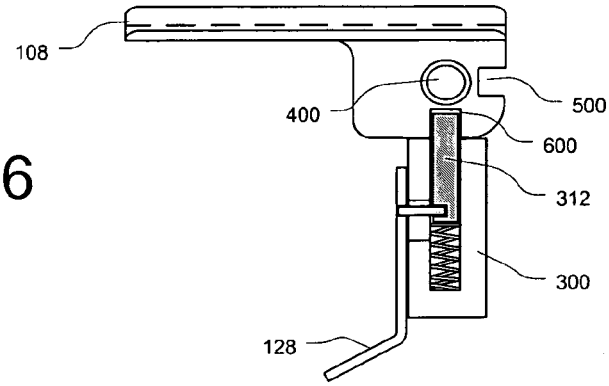
FIG. 6 illustrates a cross-sectional view of the head unit coupled to the mount in the deployed position, in accordance with an embodiment of the present invention.

304 from the stored to the deployed position, described in FIGS. 7-9, occurring simultaneously with the transition of the head unit 300 from the stored to the deployed position, described in FIGS. 5-6.

In one embodiment, the stabilization device 112 may be transferred from the deployed position, illustrated in FIG. 2, to the stored position, illustrated in FIG. 1, in the following manner. The leg tops 304 may be squeezed together by an external force applied by, e.g., an operator's hand. The cams 308 may exert a force on the wings 700 which deploys the trigger 108. The trigger 108, being so deployed, may allow the leg tops 304 to transition back into the stored position. Additionally, the deployed trigger 108 may disengage the center-pin 312 from the deployed recess 600 to allow the head unit 300 to simultaneously transition back into the stored position.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiment shown and described without departing from the scope of the present invention. Those with skill in the art will readily appreciate that the present invention may be implemented in a very wide variety of embodiments. This application is intended to cover any adaptations or variations of the embodiments discussed herein. Therefore, it is manifestly intended that this invention be limited only by the claims and the equivalents thereof.

What is claimed is:

1. An apparatus comprising:

a mount adapted to be coupled to a firearm;

a stabilization device adapted to be coupled to the mount and disposed in a first position relative to the mount, the stabilization device having a first leg, a cavity, with a seat spring and center pin disposed therein, and a trigger that, when actuated, allows the stabilization device to transition from the first position to a second position relative to the mount;

the center pin coupled to the trigger and adapted to cooperate with the seat spring to engage the mount in a manner to secure the stabilization device in a selected one of the first position or the second position;

wherein the stabilization device further includes a second leg;

and further wherein a head unit is coupled to the first leg and the second leg through a first leg top and a second leg top, respectively, and the stabilization device further includes a connecting link adapted to couple the first leg top and the second leg top to the head unit;

and wherein the stabilization device further includes:

a first cam pivotally coupled to the connecting link and statically coupled to the first leg top;

a second cam pivotally coupled to the connecting link and statically coupled to the second leg top; and the trigger being designed to engage the first and second cams in a manner to facilitate the first and second legs being secured in either the first or the second positions.

2. The apparatus of claim 1, wherein the stabilization device further comprises:

a pull-pin adapted to couple the head unit to the mount in a manner to facilitate the transition from the first position to the second position.

3. The apparatus of claim 1, wherein the actuation of the trigger disengages the center pin from the mount and allows the stabilization device to transition between the first and second positions.

4. The apparatus of claim 1, wherein the mount has a recess and the center-pin is adapted to cooperate with the seat spring to engage the mount by being at least partially disposed within the recess.

5. The apparatus of claim 1, wherein the mount has a first surface adapted to couple to a firearm, and the first position comprises the first leg being substantially parallel to the second leg and to the first surface.

6. The apparatus of claim 5, wherein the second position comprises the first leg being substantially nonparallel to the second leg and to the first surface.

7. The apparatus of claim 1, wherein the stabilization device further comprises:

a connecting link adapted to couple the first leg top and the second leg top to the head unit.

8. The apparatus of claim 1, wherein the head unit is further adapted to facilitate the first and second legs pivoting between the first and second positions.

9. The apparatus of claim 8, further comprising:

a first spring coupled to the head unit and the first leg top and adapted to facilitate the first leg pivoting between the first position and the second position; and a second spring coupled to the head unit and the second leg top and adapted to facilitate the first leg pivoting between the first position and the second position.

10. A system comprising:

a firearm;

a mount coupled to the firearm; and a stabilization device adapted to be coupled to the mount and having a first legs a second leg, and a trigger that, when actuated, allows the stabilization device to transition from a first position to a second position: the first position having a first relative positioning between the stabilization device and the mount and a second relative positioning between the first leg and the second leg, and the second position having a third relative positioning between the stabilization device and the mount and a fourth relative positioning between the first leg and the second leg;

wherein the stabilization device further includes:

a head unit coupled to the first and second legs; and a pull-pin adapted to couple the head unit to the mount in a manner to facilitate the transition from the first position to the second position and further wherein the head unit includes:

a cavity having a seat spring and a center pin disposed therein; and the center pin coupled to the trigger and adapted to cooperate with the seat spring to engage the mount in a manner to secure the stabilization device in a selected one of the first position or the second position and further wherein the mount has a first recess and a second recess and the center-pin is adapted to cooperate with the seat spring to engage the mount by being at least partially disposed within the first recess while the stabilization device is disposed in the first position and the second recess while the stabilization device is disposed in the second position.

11. The system of claim 10, wherein the actuation of the trigger disengages the center pin from a selected one of the first recess or the second recess to allow the stabilization device to transition between the first and second positions.

12. The system of claim 10, wherein the stabilization device further comprises:

a first leg top coupled to the first leg, pivotally coupled to a connecting link, and statically coupled to a first cam;

a second leg top coupled to the second leg, pivotally coupled to the connecting link, and statically coupled to a second cam; and the trigger being designed to engage the first and second cams in a manner to facilitate the first and second leg tops being secured in a selected one of the first position or the second position.

13. An apparatus comprising:

a mount adapted to be coupled to a firearm; and a stabilization device coupled to the mount and having a first leg, a second leg, and a trigger that, when actuated, allows the stabilization device to transition from a first position to a second position; the first position having a first relative positioning between the stabilization device and the mount and a second relative positioning between the first leg and the second leg, and the second position having a third relative positioning between the stabilization device and the mount and a fourth relative positioning between the first leg and the second leg;

and wherein the stabilization device further comprises:

a first cam statically coupled to the first leg; and a second cam statically coupled to the second leg, the first and second cams adapted to engage the trigger in a manner to secure the first leg and the second leg in a selected one of the second relative positioning or the fourth relative positioning.

14. The apparatus of claim 13, wherein the stabilization device further comprises:

a center pin coupled to the trigger and adapted to engage the mount in a manner to secure the stabilization device, relative to the mount, in a selected one of the first position or the second position.

15. The apparatus of claim 14, further comprising:

a seat spring to cooperate with the center pin to engage the mount; and a cavity having the seat spring and the center pin disclosed therein.

16. The apparatus of claim 13, wherein the stabilization device further comprises:

a head unit coupled to the first leg and the second leg; and a pull-pin adapted to couple the head unit to the mount in a manner to facilitate the transition from the first position to the second position.

* * * * *